US010293477B2

(12) United States Patent
Wolle et al.

(10) Patent No.: US 10,293,477 B2
(45) Date of Patent: May 21, 2019

(54) STORAGE EQUIPMENT

(71) Applicant: TTS Tooltechnic Systems AG & Co. KG, Wendlingen (DE)

(72) Inventors: Lutz Wolle, Burlafingen (DE); Markus Barabeisch, Vohringen (DE); Denny Kahn, Neu-Ulm (DE)

(73) Assignee: TTS TOOLTECHNIC SYSTEMS AG & CO. KG, Wendlingen (DE)

( * ) Notice: Subject to any disclaimer, the term of this patent is extended or adjusted under 35 U.S.C. 154(b) by 0 days.

(21) Appl. No.: 15/737,804

(22) PCT Filed: Jul. 24, 2015

(86) PCT No.: PCT/EP2015/066976
§ 371 (c)(1),
(2) Date: Dec. 19, 2017

(87) PCT Pub. No.: WO2017/016573
PCT Pub. Date: Feb. 2, 2017

(65) Prior Publication Data
US 2019/0001482 A1 Jan. 3, 2019

(51) Int. Cl.
*B65D 19/40* (2006.01)
*B25H 3/02* (2006.01)

(52) U.S. Cl.
CPC ..... *B25H 3/02* (2013.01)

(58) Field of Classification Search
CPC ..... B25H 3/02; B65D 19/00; B65D 19/40; B65D 71/0088; B65D 71/0092; B65D 71/0096
USPC ..... 206/372
See application file for complete search history.

(56) References Cited

U.S. PATENT DOCUMENTS

| | | | | |
|---|---|---|---|---|
| 3,316,045 | A | 4/1967 | Leland | |
| 2002/0125159 | A1 | 9/2002 | Hann | |
| 2008/0067095 | A1* | 3/2008 | Mueller | B25H 3/023 206/373 |

FOREIGN PATENT DOCUMENTS

| | | |
|---|---|---|
| BE | 378243 | 3/1931 |
| DE | 202009018589 | 5/2012 |
| EP | 1059240 | 12/2000 |
| EP | 1658160 | 5/2008 |
| EP | 2315701 | 5/2011 |

* cited by examiner

*Primary Examiner* — King M Chu
(74) *Attorney, Agent, or Firm* — Hoffmann & Baron, LLP

(57) ABSTRACT

Storage equipment including at least one storage container with a vertical axis, on which a coupling bar, which can rotate about a rotational axis that is at a right angle to the vertical axis, is mounted on the outside, in the upper region of the front side of same. The coupling bar is designed as a pivot bar with only one arm, which is provided with an individual bar arm, projecting away from the rotational axis on one side, on which a coupling structure is arranged. The pivot angle of the pivot bar is limited to 90° by a stop, and the pivot bar can be pivoted exclusively between an inactive standby position with the bar arm oriented at a right angle to the vertical axis, and an active coupling position projecting upwards in the axial direction of the vertical axis.

16 Claims, 6 Drawing Sheets

STORAGE EQUIPMENT

This application claims priority based on an International Application filed under the Patent Cooperation Treaty, PCT/EP2015/066976, filed Jul. 24, 2015.

BACKGROUND OF THE INVENTION

The invention relates to a storage equipment comprising at least one storage container having a vertical axis and having a container housing with a rectangular outline, on the outside of which container housing, in the upper region of its front side, there is provided a coupling latch which is rotatable about an axis of rotation extending at right angles to the vertical axis and which has a coupling structure designed for the coupling of an additional object placed on the top side of the container housing in a way which locally prevents lifting off of the coupled additional object.

A storage equipment of this type known from DE 20 2009 018 589 U1 contains one or more storage containers suitable for storing any products, such as tools or ironmongery. The storage container has a rectangular outline and is provided with coupling means which facilitate the releasable coupling of an additional object placed on top—in particular a further storage container—in a way which prevents lifting off. The coupling means include a coupling latch which is rotatably mounted in the upper region of the front side of the container housing and provided with a coupling structure which positively engages with a mating coupling structure formed on the additional object to be coupled. The known coupling latch is a cabinet lock which is rotatable about any angle of rotation and has a three-arm structure, with a coupling structure formed on each of the three arms. The operation of the coupling latch requires a certain amount of care in setting the position aimed at for coupling and uncoupling.

From U.S. Pat. No. 3,316,045 and from US 2002/0125159 A1 a storage container is known which has a one-piece carcass in which several drawers are located in a pull-out arrangement and which has an opening closed by means of a pivotably mounted cover plate on its top side.

EP 1 658 160 B1 describes a storage container which has a modular structure and is, for example, composed of three housing modules placed on top of one another in a vertical direction and latched to one another in pairs. Housing modules which are adjacent to one another in the vertical direction in each case bound together a reception compartment which is open towards the front of the container housing and in which a drawer element is located.

SUMMARY OF THE INVENTION

The invention is based on the problem of creating a storage equipment which facilitates the releasable coupling of a storage container to an additional object placed thereon by simple and reliable means.

To solve this problem, it is provided, in combination with the features mentioned above, that the coupling latch is a single-arm pivot latch which has a single latch arm having the coupling structure and projecting from the axis of rotation on one side, wherein the single-arm pivot latch is pivotable about a pivoting angle limited to 90° by stop means located on the container housing exclusively between an inactive standby position with the latch arm oriented perpendicular to the vertical axis and an active coupling position with the latch arm being upright and projecting upwards in the axial direction of the vertical axis for coupling an additional object placed on the top side of the container housing.

In this way an additional object placed on the top side of the container housing can be simply and reliably coupled to the storage container in a releasable manner in such a way that it can no longer be lifted off the storage container, at least locally in the region of the coupling latch. In place of a multi-arm cabinet lock, the coupling latch is designed as a single-arm pivot latch with only one latch arm projecting away from the axis of rotation, on which the single coupling structure of the coupling latch is located as well. The associated stop means, which are likewise located on the container housing of the storage container, precisely preset two pivoting movements of the pivot latch, these being an active coupling position on the one hand and an inactive standby position on the other hand. The pivot latch cannot be pivoted beyond these two positions, so that the user of the storage container is capable of positioning the pivot latch safely and reliably in the desired position even without eye contact. In the inactive standby position of the pivot latch, the latch arm is oriented at right angles to the vertical direction of the storage container, thereby as a whole adopting a position in which it lies below the top side of the storage container and therefore does not impede the placing or removal of an additional object depending on requirements. In the active coupling position, the latch arm extends parallel to the vertical axis of the storage container and projects beyond its top side, so that it can come into coupling engagement with an additional object placed there.

Advantageous further developments of the invention emerge from the dependent claims.

The stop means expediently comprise two first and second stop legs arranged in an L-shaped configuration on the outside at the front of the container housing. One—the first—of these two stop legs is responsible for setting the active coupling position, while the other—the second—stop leg presets the inactive standby position.

The two stop legs are preferably formed integrally on the container housing. Between the stop legs, there may be a gap, so that the stop legs are not directly connected to each other. In an expedient embodiment, however, the two stop legs are represented by opposing end sections of a stop rib which is formed in one piece with the container housing on the outside thereof and has a longitudinal dimension which is angled or bent at a right angle. With such a stop rib, the rotary bearing zone for the pivot latch, which is in each case expediently bounded on one side laterally and below by the two stop legs, is shielded over a wide area. In addition, this results in a high stability of the stop means, and the risk that one or the other stop leg might break off is greatly reduced.

In the case of a stop rib with an angled or bent longitudinal dimension, the two stop legs are expediently joined to each other in one piece by a bow-shaped connecting section of the stop rib placed in between.

Each of the two stop legs is expediently itself designed to be rib-shaped, having preferably a linear longitudinal extension.

It is advantageous if the pivot latch is in its inactive standby position releasably fixed in such a way that it does not automatically swivel towards the active coupling position if shaken or if the container housing is positioned at an angle. A snap means structure is therefore preferably provided and in particular formed integrally on the outside at the front of the container housing, whereby the pivot latch placed in the inactive standby position is releasably latched so that it cannot be pivoted. The latching engagement can be cancelled manually at any time using a little more force, in order to pivot the pivot latch into the active coupling position if required.

In principle, it is irrelevant with which components of the pivot latch the snap means structure cooperates. It is, however, particularly advantageous if it cooperates with the latch arm. To cooperate with the snap means structure, the latch arm preferably has a mating snap means structure which is independent of the coupling structure. In a particularly simple design, the mating snap means structure is directly represented by the coupling structure of the latch arm.

It is advantageous if the storage container has on the outside in the lower region of its front side a mating coupling structure which is complementary to the coupling structure of the latch arm. In this way, it can be vertically coupled to similar containers in the stacked state. The storage equipment is preferably equipped with several storage containers, each having at the front in the upper region a single-arm pivot latch and in the lower region a mating coupling structure, so that in the stacked state of several of these storage containers the respective lower storage container of a pair of storage containers sitting on top of each other is positively coupled to or can be uncoupled if required from the storage container placed above by pivoting its pivot latch. Although the several storage containers are designed identically in terms of their pivot latches and mating coupling structures, they can be quite different in other ways, in particular in their overall heights. The outline is preferably identical for all storage containers. The several storage containers can obviously also be completely identical, at least in parts. In the stacked state of two storage containers, the storage container sitting on top of the lower storage container is the additional object mentioned above. However, other additional objects, e.g. a worktop, can also be fixed on each storage container by means of the pivot latch in a way which prevents lifting off at least partially.

The coupling structure and the mating coupling structure preferably have a hook-shaped profile of complementary design. The hook profile preferably has an undercut profiling, so that there is a positive engagement in the coupled state not only in the vertical direction, but also in the depth direction—perpendicular to the front side—of the storage container.

On its front side, the at least one storage container preferably only has a single pivot latch, which is in particular placed in the middle of its width. In principle, however, more than one and in particular two pivot latches can be provided on the front side of the container housing.

It is furthermore possible to provide a pivot latch and preferably a complementary mating coupling structure not only on the front side, but in addition on at least one of the other outsides of the container housing. If several pivot latches are distributed along the contour of the container housing, an additional object sitting on the storage container can, simply by activating the several pivot latches, be fixed in such a way that it cannot be lifted off the storage container below at all.

The at least one pivot latch and the preferably also provided mating coupling structure are preferably components of coupling means which contain further parts. One of these coupling means is preferably an upper supplementary coupling device which is located on the top side of the storage container at a distance from the pivot latch and which is capable of releasable engagement with a complementary lower supplementary coupling device on the underside of an additional object placed on the container housing, in order to define at least one further region in which the additional object is coupled to the storage container below in a way which prevents lifting off. The multiple coupling zones provided in this way ensure that the additional object placed on and coupled to the storage container is in its entirety fixed to the storage container in a way which prevents lifting off.

On its underside, the storage container is expediently provided with a lower supplementary coupling device which is complementary to the upper supplementary coupling device on the top side. This facilitates the stacking of identical storage containers and their coupling in a way which prevents lifting off.

The upper supplementary coupling device expediently has at least one engagement recess which has an undercut cross-section and with which the lower supplementary coupling device can be brought into engagement by means of at least one engagement projection which likewise has an undercut cross-section.

The container housing of the at least one storage container expediently defines at least one housing interior which is accessible for placing or removing objects either directly or following manipulation at one or more cover plates and/or one or more drawer elements. A container housing of a preferred construction has at least one reception compartment which is open at a compartment opening on a front side of the container housing and in which a drawer element is located in a pull-out and push-in arrangement. The container housing can contain several reception compartments arranged on top of one another in the vertical direction, each fitted with its own drawer element.

It is particularly advantageous if the container housing has a modular structure and is composed of several housing modules arranged on top of one another in the vertical direction of the container housing and latched to one another in pairs in a way which prevents lifting off one another. Two housing modules arranged immediately on top of each other jointly define a reception compartment for a pull-out and push-in drawer element.

On the top side, the container housing is expediently provided with a carrying handle of a bow-shaped design, which facilitates an easy manual transport of the storage container. The carrying handle is expediently mounted pivotably on the top side of the container housing in such a way that it can optionally be positioned in a position of non-use pivoted towards the container housing or in an upward-projecting position of use. In the position of non-use, the carrying handle is expediently recessed into the container housing, so that the placement of an additional object is not impeded.

If several storage containers are vertically coupled by the coupling means in a way which prevents lifting off and combined to form a stacked assembly, this can easily be transported using the carrying handle of the uppermost storage container.

Each storage container is in addition preferably structured in such a way that an additional object placed on it, which may be a further storage container in particular, is undisplaceably supported at right angles to the vertical axis. For this purpose, the storage container expediently has on its top side several recesses with which corresponding projections on the underside of the additional object engage when the additional object is placed on the storage container.

BRIEF DESCRIPTION OF THE DRAWINGS

The invention is explained in greater detail below with reference to the enclosed drawing, of which.

DETAILED DESCRIPTION OF THE PREFERRED EMBODIMENTS

Figure 1:
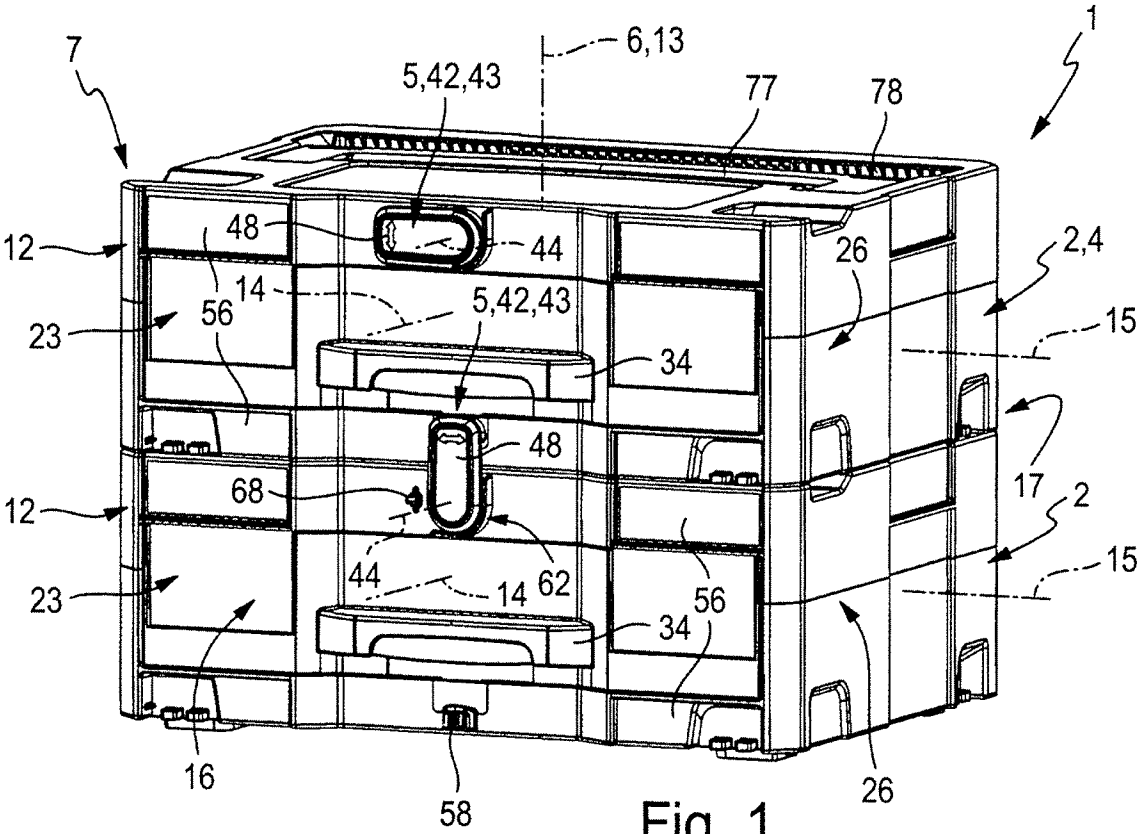
FIG. 1 shows a storage equipment composed of two storage containers, the two storage containers being illustrated in the stacked state and coupled in such a way that they cannot be lifted off each other in the vertical direction.
Figure 2:
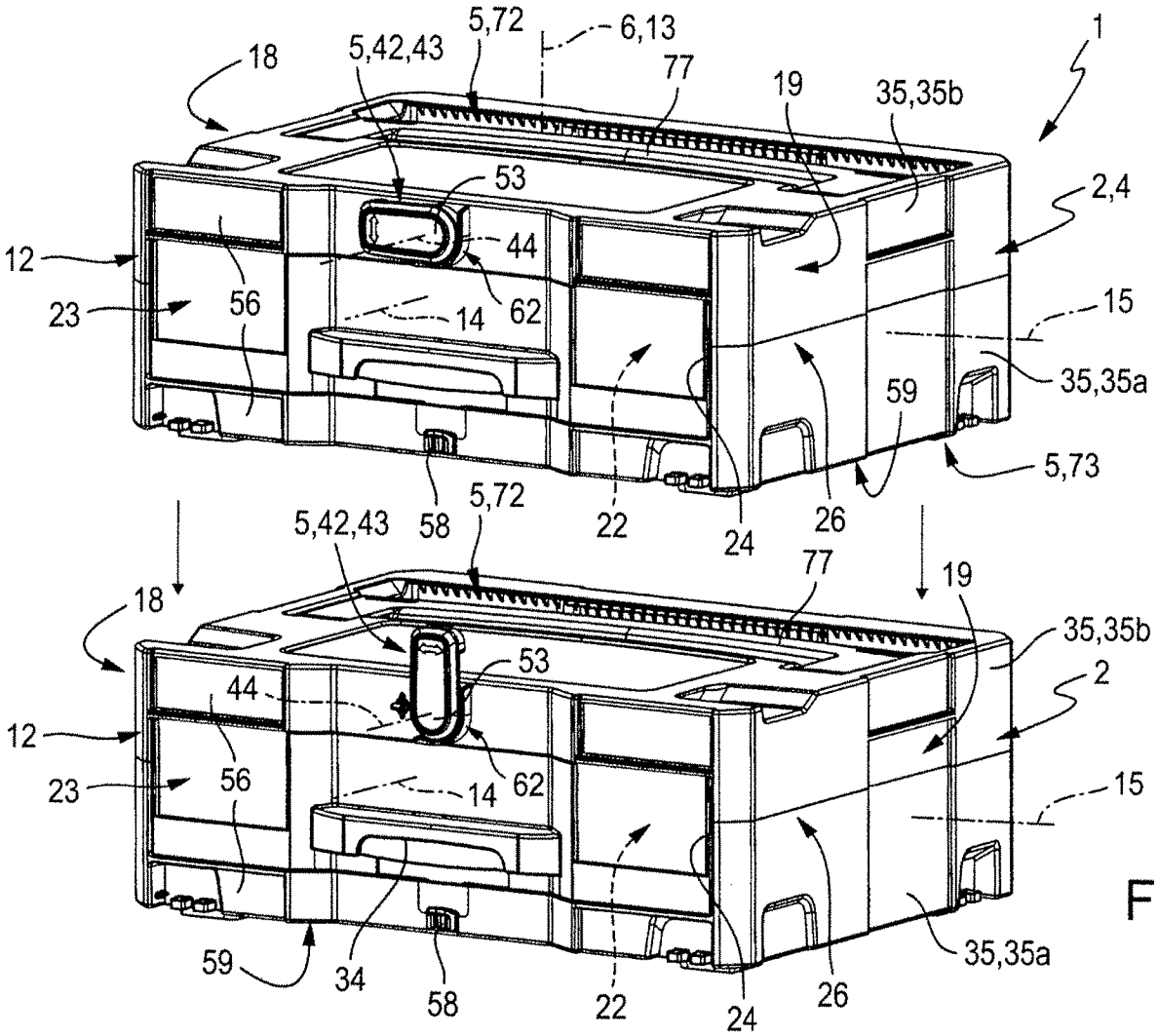
FIG. 2 shows the storage equipment from FIG. 1 with the two storage containers lifted off each other.

The storage equipment identified in its entirety by the reference number 1 comprises one or more storage containers 2, each having at least one housing interior 3 and therefore being capable of storing parts of any kind, for example tools, when not in use.

The special feature of each storage container 2 is the fact that an additional object 4 can be placed on top of it; this can be coupled to the storage container 2 with the aid of coupling means 5 of the storage container 2 in order to produce a coherent stacked assembly which can be transported as a unit.

Figure 6:
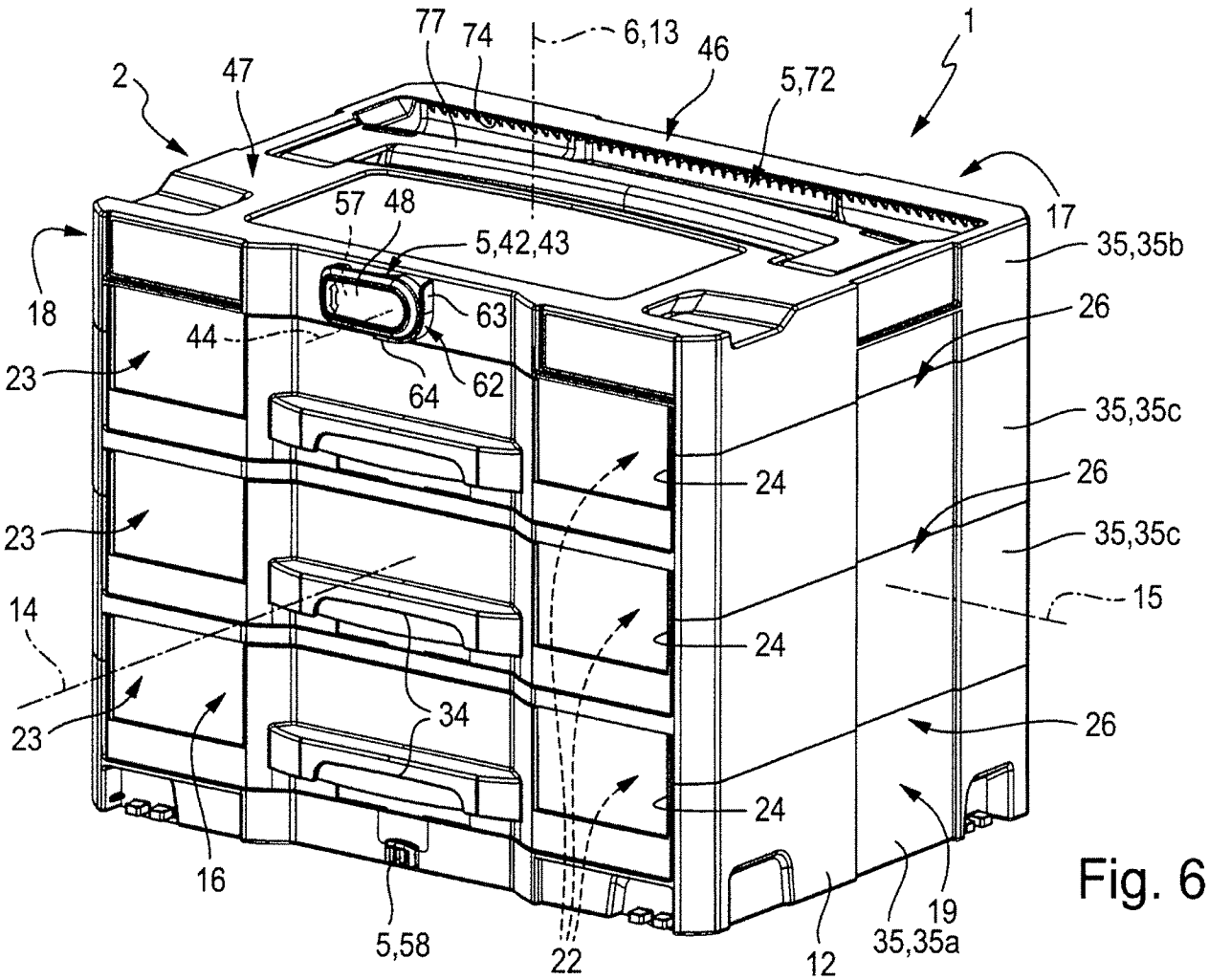
FIG. 6 shows an individual storage container of the storage equipment which differs from the storage container shown in duplicate in the other figures in its overall height among other aspects.

In the simplest case, the storage equipment 1 comprises a single storage container 2 fitted with the coupling means 5 as in the embodiment of FIG. 6. With this storage container 2, any additional object having its own coupling means corresponding to the coupling means 5 of the storage container 2 can be stacked and coupled. This may, for example, be a work surface or a table top, or else a chest. The additional object 4 may also be a further storage container, in particular of the same type as the storage container 2 fitted with the coupling means 5.

Figure 3:
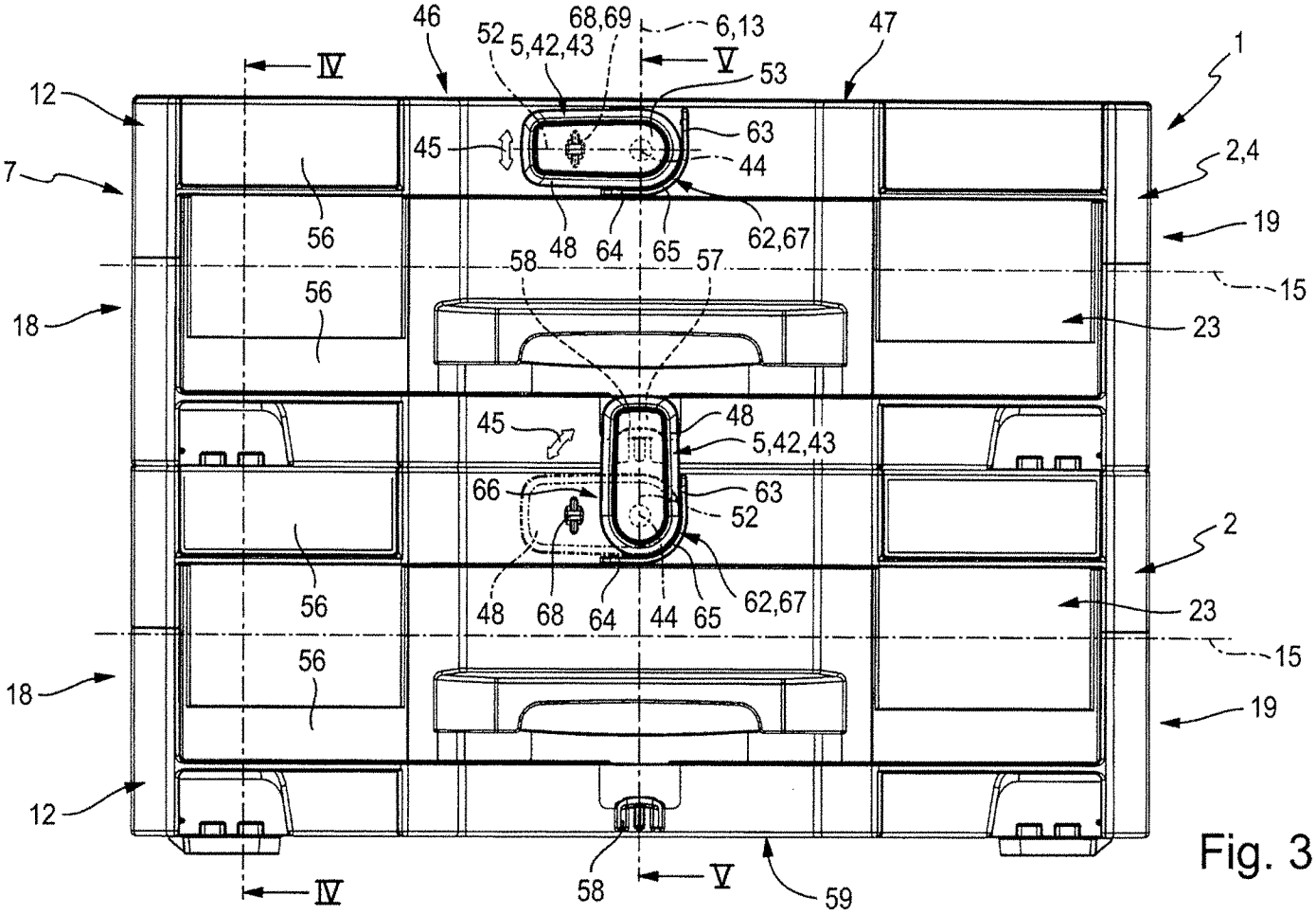
FIG. 3 is a front view of the storage equipment from FIG. 1.
Figure 4:
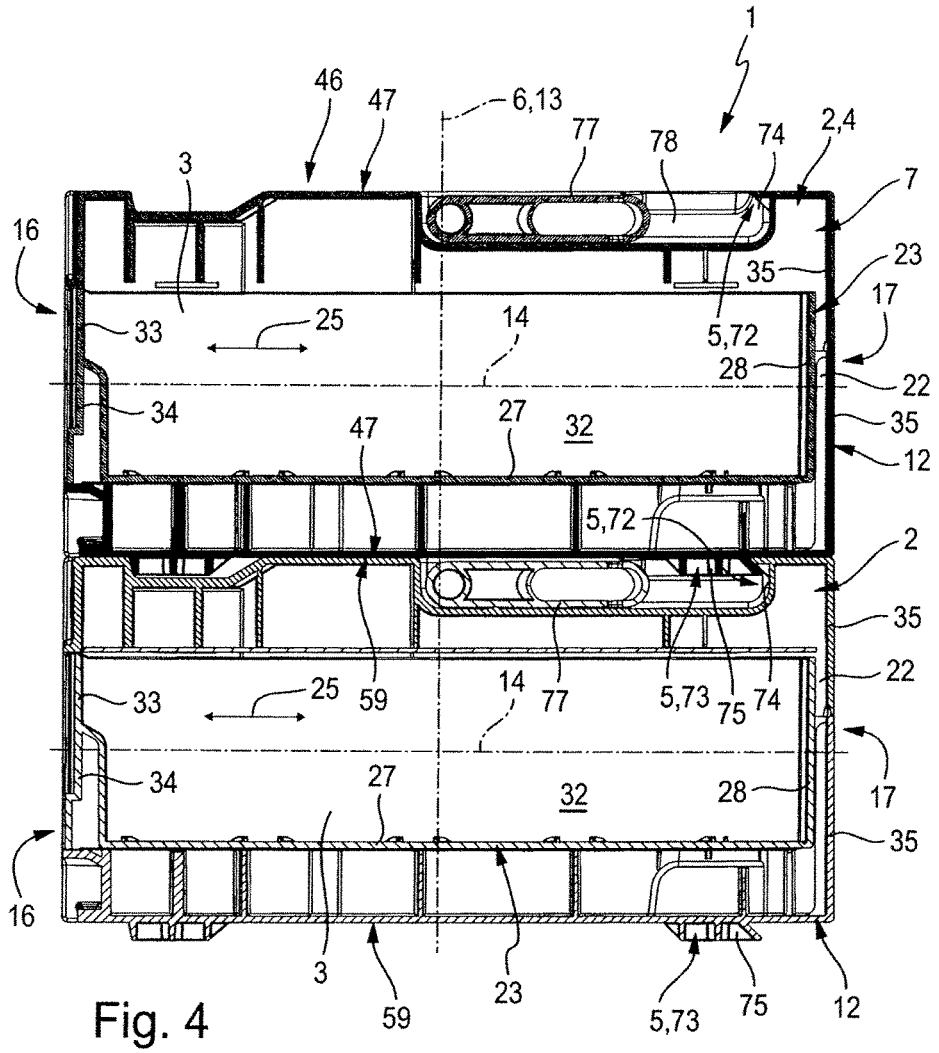
FIG. 4 is a vertical section along line IV-IV from FIG. 3 through the storage equipment with the two storage containers placed on top of each other.
Figure 5:
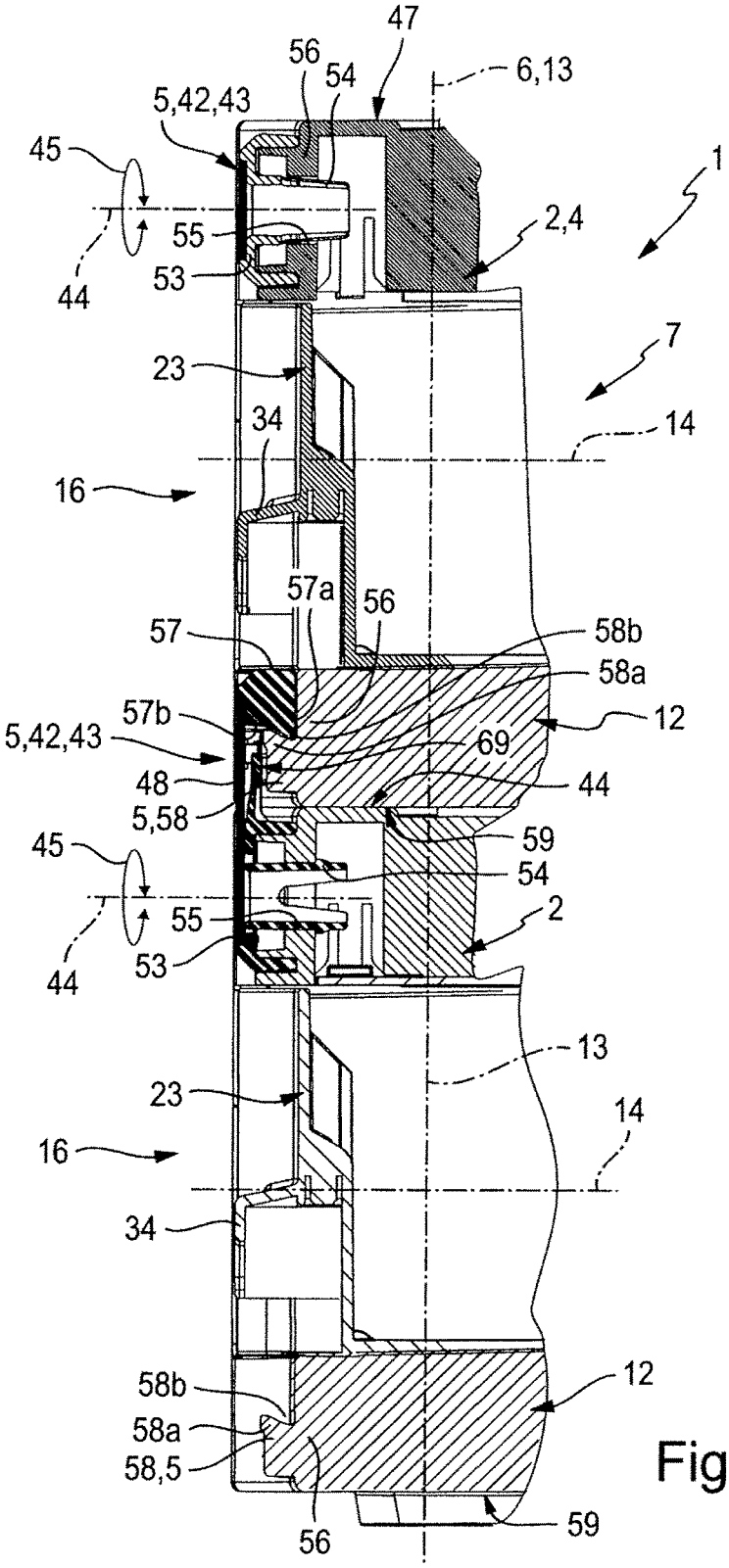
FIG. 5 is a further vertical section along line V-V from FIG. 3 with the sectional plane extending through the axis of rotation of the pivot latches.

In a preferred embodiment, the storage equipment 1 comprises, in addition to the storage container 2, an additional object 4 suitable for stacking with and coupling to this storage container 2, which applies to the embodiments of FIGS. 1 to 5. It is particularly advantageous if the additional object 4 is a further storage container 2 which is provided with coupling means 5 in the same way as the first storage container 2. It is then possible to stack several of the storage containers 2 on top of one another in a vertical direction 6 indicated by a dot-dash line and to couple two storage containers 2 located immediately on top of each other using the coupling means 5 in such a way that they cannot be lifted off each other in the vertical direction 6. This results in a stacked assembly 7 as shown in FIGS. 1 and 3, for example, which can as a whole be picked up from a base by grabbing and lifting the topmost storage container 2.

It is particularly expedient if the storage equipment is composed of two or more storage containers 2 which match one another in their outline and in the design of their coupling means 5. The overall height of at least some of these storage containers 2 can be identical as well, and it is possible to design several of the storage containers 2 of the storage device 1 to be identical as a whole. On the other hand, several of the storage containers 2 can differ in their overall height, which has the advantage of making available storage containers 2 with different storage volumes, which can be coupled to form the stacked assembly 7 irrespective of their different overall heights.

FIG. 6 of the drawing shows a storage container 2 with coupling means 5 corresponding to those of the storage containers 2 shown in FIGS. 1 to 5, but having a greater overall height.

Such a storage container 2 designed as shown in FIG. 6 can, for example, form the storage equipment 1 together with one or more of the storage containers 2 shown in FIGS. 1 to 5, so that the storage equipment 1 has several storage containers 2 of different overall height, which can be stacked on top of one another and coupled to one another in the vertical direction.

If the coupling means 5—as preferred—are in all storage containers 2 designed to match, this offers the advantage that the storage containers 2 can be stacked in any sequence. Based on the embodiments, it is therefore possible to place a higher storage container 2 below a lower storage container 2 or vice versa.

All of the storage containers 2 shown in the drawing have the same outline and are provided with the same coupling means 5. Any differences are limited to measures of influencing the overall height and the capacity and possibly the usability of the capacity.

Owing to this extensive conformity, the following statements apply to all of the illustrated storage containers 2. Any differences are explicitly addressed.

Each storage container 2 has a container housing 12 with a vertical axis 13, the axial direction of the vertical axis 13 being hereinafter also described as vertical direction 13. Any number of storage containers 2 can be stacked on top of one another in the vertical direction 13 in such a way that the vertical axes 13 of all stacked storage containers 2 coincide with the vertical direction 6 of the stacked assembly 7.

The container housing 12 has a rectangular outline with a longitudinal axis 14 defining the depth direction of the container housing 12 and a transverse axis 15 perpendicular thereto, its axial direction defining the width direction of the container housing 12. As a whole, the container housing 12 preferably has a cuboid basic structure.

In the usual position of use of the storage container 2, the vertical axis 13 of the container housing 12 is oriented vertically.

The storage container 2 has a front side 16 oriented in the axial direction of the longitudinal axis 14 and a rear side 17 opposite the former. The container housing 12 further has two lateral outsides 18, 19 arranged opposite each other and oriented in the axial direction of the transverse axis 15.

The means facilitating the use of the housing interior 3 for storing parts can be of any type. The storage container 2 can, for example, have an upward-oriented access opening through which the housing interior 3 is accessible and which is either always open or has a removable or pivotable cover plate.

In the illustrated embodiment, the housing interior 3 is made accessible for use by providing that the container housing 12 defines at least one reception compartment 22 for a drawer element 23. Depending on embodiment, the container housing 12 contains only one reception compartment 22—this applies to the embodiment of FIGS. 1 to 5—or a plurality of reception compartments 22 arranged on top of one another in the vertical direction 13. The latter is the case in the embodiment of FIG. 6, in which the container housing 12 contains a total of three reception compartments 22 arranged on top of one another. In principle, any number of compartments is possible, depending on the need for storage facilities.

Each reception compartment 22 is accessible from the outside through its own compartment opening 24 located on the front side 16. In each reception compartment 22, a drawer element 23 is located; within an operating movement 25 indicated by a double-headed arrow in FIG. 4 and oriented in the axial direction of the longitudinal axis 14, this can optionally be pulled out of the associated reception compartment 22 or pushed into the respective reception compartment 22.

For each reception compartment 22, the container housing 12 forms a compartment side wall 26, which bounds the associated reception compartment 22 at the sides oriented at right angles to the vertical axis 13—with the exception of the region of the compartment opening 24. Apart from the compartment opening 24 facilitating access to the drawer element 23, each compartment side wall 26 preferably extends as a closed wall around the associated reception compartment 22.

Each drawer element 24 expediently has a base wall 27 of a preferably plate-shaped design. Around the edge of the base wall 27, there extends an outer wall 28 of the drawer element 23, which, together with the base wall 27, bounds a drawer interior 32 for storing parts. If the drawer element 23 is at least partially pulled out of the associated reception compartment 22 at the front side 16 of the container housing 12, the drawer interior 32 is open towards the top and accessible for placing or removing parts.

On the outside—remote from the drawer interior 32—of a front outer wall section 33 of the drawer element 23, which lies in the region of the compartment opening 24 in the pushed-in state, there is expediently provided a handle 34, on which the drawer element 23 can be gripped to pull it out of or to push it back into the reception compartment 22.

The container housing 12 can have a one-part or a multi-part structure. A modular structure in which the container housing 12 is composed of several housing modules 35 arranged on top of one another in the vertical direction 13 and latched to one another in a way which prevents lifting off is particularly advantageous. Two housing modules 35 placed immediately on top of each other in each case bound one of the reception compartments 22 described above.

The housing modules 35 preferably comprise a lower housing end module 35*a* and an upper housing end module 35*b*. If the storage container 2 is to have only one reception compartment 22, these upper and lower housing end modules 35*a*, 35*b* are directly fitted to each other and permanently joined to each other. To obtain several reception compartments 22, any number of housing intermediate modules 35*c* can be incorporated between the lower housing end module 35*a* and the upper housing end module 35*b*. Each housing intermediate module 35*c* bounds two reception compartments 22 placed on top of each other. The more reception compartments 22 are wanted, the more housing intermediate modules 35*c* are incorporated between the lower housing end module 35*a* and the upper housing end module 35*b*.

The coupling means 5, which are identical in all embodiments of the storage container 2, are described in greater detail below.

The coupling means 5 comprise a coupling latch 42, which is located on the outside of the container housing 12 in the upper region of its front side 16 and designed as a single-arm pivot latch 43. The pivot latch 43 is pivotable relative to the container housing 12 about an axis of rotation 44, the pivoting movement being indicated by double-headed arrows 45. The axis of rotation 44 is perpendicular to the vertical axis 13 and extends more specifically in the axial direction of the longitudinal axis 14 of the container housing 12.

The container housing 12 has a top side 46 oriented upwards in the vertical direction. On this top side 46, the container housing 12 has an upper placement surface 47, on which the additional object 4—in particular a further storage container 2—placed on the storage container 2 rests. The axis of rotation 44 lies vertically below the upper placement surface 47.

Relative to the container width as measured in the axial direction of the transverse axis 15, the axis of rotation 44 of the pivot latch 43 is preferably placed in the centre. There is expediently only a single pivot latch 43 on the front side 16 of the container housing 12. The coupling means 5 provided in the illustrated embodiment are in addition characterised by the fact that, apart from the pivot latch 43 located on the front side 16, there is no further pivot latch 43, and all further components of the coupling means 5 are immovable relative to the container housing 12 supporting them.

The single-arm pivot latch 43 has a single latch arm 48 projecting radially from the axis of rotation 44. This latch arm 48 is preferably designed in the manner of a tab.

The latch arm 48 has an arm longitudinal axis 52 extending radially relative to the axis of rotation 44. In the region of one of its two axial end sections, which shall be described as bearing section 53 hereinafter, the latch arm 48 is mounted for rotation about the axis of rotation 44. To define the axis of rotation 44, a rotary bearing extension 54 projecting away from the rear is expediently formed integrally on the bearing section 53; this rotatably engages with a bearing recess 55 of that housing wall 56 of the container housing 12 which is assigned to the front side 16. The latch arm 48 is preferably fixed immovably on the container housing 12 in the axial direction of the axis of rotation 44 by latching the rotary bearing extension 54 into the bearing recess 55.

At a radial distance from the bearing section 53, the latch arm 48 has a coupling structure 57 at its rear facing the container housing 12. This coupling structure 57 preferably has a hook-shaped profile and is provided with a coupling projection 57*a* projecting towards the axis of rotation 44. This coupling projection 57*a* bounds a coupling recess 57*b* of the coupling structure 57 on the side of the coupling projection 57*a* which is remote from the container housing 12.

The coupling means 5 of the storage container 2 further comprise a mating coupling structure 58 of a design matching the coupling structure 57. Like the pivot latch 43, this is located at the front side 16 of the container housing 12 and is there in particular formed integrally with the front housing wall 56. The mating coupling structure 58 and the axis of rotation 44 of the pivot latch 43 lie on a common axis which extends parallel to the vertical axis 13. As a result, the mating coupling structure 58 is located directly vertically below the axis of rotation 44 in the position of use of the storage container 2, lying in the lower region of the front side 16 of the container housing 12.

On its underside, the container housing 12 is bounded by a lower base surface 59 on the outside. In the stacked state of two storage containers 2, the upper storage container 2 expediently sits with its lower base surface 59 on the upper placement surface 47 on the top side 46 of the lower container housing 12.

Relative to the vertical direction 13, the mating coupling structure 58 is expediently located in the immediate vicinity of the lower base surface 59 on the front side 16 of the container housing 12.

The stationary mating coupling structure 58, which is immovably mounted on the container housing 12, is designed complementary with regard to the coupling structure 57 located on the pivotable pivot latch 43. In the illustrated embodiment, it comprises an upward-projecting mating coupling projection 58*a*, which is located slightly in front of the front housing wall 56, so that it bounds a mating coupling recess 58*b* together with this front housing wall 56.

If two storage containers 2 are placed on top of each other, the mating coupling structure 58 of the upper storage container 2 adopts a position above the axis of rotation 44 of the storage container 2 placed below. The distance of the mating coupling structure 58 from the axis of rotation 44 is dimensioned such that the mating coupling structure 58 can be overlapped by the coupling structure 57 of the latch arm 48 if the pivot latch 43 is pivoted into an active coupling position.

In FIGS. 1 to 5, the pivot latch 43 of the lower storage container 2 has adopted the active coupling position. In this active coupling position, the latch arm 48 projects vertically upwards from the axis of rotation 44, its longitudinal section with the coupling structure 57 projecting beyond the upper placement surface 47 in an upward direction. The height of this projection is chosen such that the coupling structure 57 overlaps the adjacent mating coupling structure 58 on the top side.

The coupling structure 57 thus dips with its coupling projection 57*a* from above into the mating coupling recess 58*b* of the mating coupling structure 58, which in turn dips with its upward-projecting mating coupling projection 58*a* into the coupling recess 57*b* of the coupling structure 57.

On the one hand, this results in the vertical direction 13 in a positive engagement between the coupling structure 57 and the mating coupling structure 58, which ensures that the upper storage container 2 can no longer be lifted off the lower storage container 2 in the region of its front side 16. On the other hand, the mutual engagement in the vertical direction 13 between the coupling structure 57 and the mating coupling structure 58 also provides a positive engagement in the depth direction of the container housing, so that the coupling engagement is not lost even if the upper storage container 2 moves slightly relative to the lower storage container 2 in a horizontal plane perpendicular to the vertical axis 13.

Stop means 62 located on the outside on the front side 16 of the container housing 12 and being in particular formed integrally therewith limit the pivoting angle of the pivot latch 43 to 90°. One of the two pivoting end positions of the pivot latch 43 as predetermined by the stop means 62 is the above-mentioned active coupling position, in which the latch arm 48 is in an upright position and projects upwards in the axial direction of the vertical axis 13. The second pivoting end position of the pivot latch 43 as predetermined by the stop means 62 is an inactive standby position as set in FIG. 6 and the other figures for the upper storage container 2. In this inactive standby position, the latch arm 48 is oriented perpendicular to the vertical axis 13, i.e. its longitudinal axis 52 extends in a horizontal plane which is perpendicular to the vertical axis 13.

In the inactive standby position of the pivot latch 43, the coupling to the mating coupling structure 58 of the storage container 2 placed above is released, and it can be removed or replaced without impediment.

The stop means 62 comprise first and second stop legs 63, 64 located on the outside at the front housing wall 56 of the container housing 12. The first stop leg 63 is used to preset the active coupling position and extends in the axial direction of the vertical axis 13. The second stop leg 64, which is placed lower than the first stop leg 63 in the vertical direction 13, is used to preset the inactive standby position and extends at right angles to the vertical axis 13.

The two stop legs 63, 64 are arranged in a way which can be compared to the mutually perpendicular sides of a right-angled triangle. Together they bound a rotary bearing zone 66 in which the latch arm 48 with its rotary bearing extension 54 is rotatably mounted. The rotary bearing zone 66 lies above the horizontal second stop leg 64 while being adjacent to the vertical first stop leg 63.

It is advantageous if the two stop legs 63, 64 are integrally joined to each other via a bow-shaped connecting section 65. In this case, the two stop legs 63, 64 and the connecting section 65 together form a one-piece stop rib 67, the end sections of which are straight, each forming one of the stop legs 63, 64. The rotary bearing zone 66 is located on the concave side of the curved connecting section 65.

The coupling structure 57 and the mating coupling structure 58 are preferably matched in such a way that the two structures 57, 58 are releasably latched in the direction of rotation 45 in the active coupling position of the pivot latch 43. In this way, the unintentional release of the coupling engagement if the container assembly if shaken can be prevented by simple means.

It is furthermore advantageous if the pivot latch 43 is fixed relative to the container housing 12 by latching with a snap function in the inactive standby position, so that a slightly increased effort is initially required for pivoting into the active coupling position.

Such a snapping facility is provided in the illustrated embodiments. On the front side 16 on the outside of the container housing 12, in that region which is covered by the latch arm 48 in the inactive standby position, a snap means structure 68 is here provided and formed integrally in particular. The snap means structure 68 expediently projects beyond the front housing wall 56. At its rear facing the container housing 12, the latch arm 48 is provided with a mating snap means structure 69, which is in releasable latching engagement with the snap means structure 68 if the pivot latch 43 is or has been pivoted into the inactive standby position.

The mating snap means structure 69 is expediently formed on the latch arm 48 in addition to the coupling structure 57. The mating snap means structure 69 can, however, also be directly represented by the coupling structure 57.

The coupling means 5 expediently also comprise an upper supplementary coupling device 72 formed on the top side 46 of the container housing 12 and a lower supplementary coupling device 73 formed on the underside 59 of the container housing 12. If two storage containers 2 are stacked on top of each other, the upper storage container 2 engages with its lower supplementary coupling device 73 from above with the upper supplementary coupling device 72 of the storage container 2 placed below. This results, at least in the axial direction of the longitudinal axis 14, in an undercut which ensures that the two supplementary coupling devices 72, 73 can no longer be separated vertically once they are in mutual engagement.

As the two supplementary coupling devices 72, 73 are arranged at a distance from the pivot latch 43 and the mating snap means structure 69 in the axial direction of the longitudinal axis 14, the result is a multiple vertical coupling in a horizontal plane perpendicular to the vertical axis 13, with the effect that the two storage containers 2 are coupled in a way which prevents their lifting off each other.

The upper supplementary coupling device 72 expediently consists of one or more engagement recesses 74, while the lower supplementary coupling device 73 consists of one or more engagement projections 75. Both each engagement recess 74 and each engagement projection 75 has an undercut cross-section, resulting in a positive connection in the vertical direction 13 in the engaged state.

In the illustrated embodiment, the upper and the lower supplementary coupling devices 72, 73 are designed such that they can be brought into engagement in the inactive standby position of the pivot latch 43 if the upper storage container 2 is placed on the lower storage container 2 from above in an inclined position with its front raised. In the further coupling process, the upper storage container 2 is pivoted downwards in the region of the front until it lies fully on the placement surface 47 of the lower storage container 2. As a last step to a coupling of the two storage containers 2 which cannot be cancelled, the pivot latch 43 of the lower storage container 2 is pivoted into the active coupling position.

The upper and lower supplementary coupling devices 72, 73 are expediently comparable to the design known from DE 20 2009 018 589 U1 referred to above.

On the top side 46, the container housing 12 is expediently provided with a carrying handle 77 of a bow-like design, which facilitates an easy manual transport of the storage container 2 or the stacked assembly 7. The carrying handle 77 is expediently mounted pivotably on the top side 46 of the container housing 12 in such a way that it can optionally be positioned in a position of non-use pivoted towards the container housing 12 or in an upward-projecting position of use. In the position of non-use, the carrying handle 77 is expediently recessed into a recess 78 formed on the top side 46 of the container housing 12, so that the placement of an additional object 4 is not impeded.

If several storage containers 2 are vertically coupled by the coupling means 5 in a way which prevents lifting off and combined to form a stacked assembly 7, this stacked assembly 7 can easily be transported using the carrying handle 77 of the uppermost storage container 2.

The invention claimed is:

1. Storage equipment comprising at least one storage container with a vertical axis, which has a container housing with a rectangular outline, on the outside of which container housing, in the upper region of its front side, there is provided a coupling latch which is rotatable about an axis of rotation extending at right angles to the vertical axis and which has a coupling structure designed for the coupling of an additional object, which is placed on the top side of the container housing, in a way which locally prevents lifting off of the coupled additional object, wherein the coupling latch is an only single-arm pivot latch which has a single latch arm provided with the coupling structure and projecting from the axis of rotation on one side, wherein the single-arm pivot latch is pivotable about a pivoting angle limited to 90° by stop means located on the container housing exclusively between an inactive standby position with the latch arm oriented perpendicular to the vertical axis and an active coupling position with the latch arm being upright and projecting upwards in the axial direction of the vertical axis for coupling an additional object placed on the top side of the container housing.

2. The storage equipment according to claim 1, wherein the stop means comprise two first and second stop legs arranged in an L-shaped configuration on the outside of the container housing, of which a first stop leg used for setting the active coupling position extends in the axial direction of the vertical axis and a second stop leg used for setting the inactive standby position extends at a right angle thereto.

3. The storage equipment according to claim 2, wherein the two stop legs laterally and below bound a rotary bearing zone, in which the pivot latch is rotatably mounted on the container housing.

4. The storage equipment according to claim 2, wherein the two stop legs are represented by opposing end sections of a stop rib which is formed in one piece with the container housing on the outside thereof and has a longitudinal dimension which is angled or bent at a right angle.

5. The storage equipment according to claim 4, wherein the stop rib has a bow-shaped connecting section, which joins the two stop legs in one piece and the concave side of which faces the axis of rotation of the pivot latch.

6. The storage equipment according to claim 1, wherein a snap means structure, which is in releasable snapping engagement with the latch arm in the inactive standby position, thereby releasably fixing the inactive standby position, is provided on the outside on the front side of the container housing.

7. The storage equipment according to claim 1, wherein the at least one storage container has on the outside in the lower region of its front side, a mating coupling structure, which is complementary to the coupling structure of the latch arm of its pivot latch and to which a rotatable coupling latch of an additional object placed under the storage container can be releasably coupled.

8. The storage equipment according to claim 1, wherein an additional object is a component of the storage equipment which can be placed on the top side of the storage container and which has on the outside in the lower region of its front side a mating coupling structure, which is complementary to the coupling structure of the latch arm of the pivot latch of the storage container and with which the coupling structure of the latch arm pivoted into the active coupling position is in coupling engagement in a way which prevents a local lifting off of the additional object placed on the top side of the storage container.

9. The storage equipment according to claim 7, wherein the coupling structure and the mating coupling structure are profiled in a hook-shaped manner complementary to each other.

10. The storage equipment according to claim 1, wherein an additional object is one of several storage containers of the storage equipment, which can be stacked on top of one another in the axial direction of the vertical axis.

11. The storage equipment according to claim 1, wherein the at least one storage container has on the top side of its container housing an upper supplementary coupling device, which is located at a distance from the pivot latch and can be or is in releasable engagement with a complementary lower supplementary coupling device located on the underside of an additional object placed on the container housing in order to couple the additional object in its entirety to the storage container placed below in a way which prevents vertical lifting off.

12. The storage equipment according to claim 11, wherein the at least one storage container has on its underside a lower supplementary coupling device, which is complementary to the upper supplementary coupling device.

13. The storage equipment according to claim 11, wherein the upper supplementary coupling device consists of at least one engagement recess having an undercut cross-section and the lower supplementary coupling device consists of at least one engagement projection having an undercut cross-section.

14. The storage equipment according to claim 1, wherein the container housing of the at least one storage container comprises at least one reception compartment with a compartment opening on a front side of the container housing and a drawer element located in the reception compartment in a pull-out and push-in arrangement.

15. The storage equipment according to claim 1, wherein the container housing of the at least one storage container has a modular structure and is composed of several housing modules arranged on top of one another in the axial direction of the vertical axis and latched to one another in pairs in a way which prevents lifting off from one another, wherein each two housing modules arranged immediately on top of each other jointly define a reception compartment for a pull-out and push-in drawer element.

16. The storage equipment according to claim 7, wherein the additional object placed under the storage container is a further storage container.

* * * * *